US008226132B2

(12) United States Patent
Zinn

(10) Patent No.: US 8,226,132 B2
(45) Date of Patent: Jul. 24, 2012

(54) OPENING MEANS FOR A CLOSING UNIT

(75) Inventor: Jürgen Zinn, Heiligenhaus (DE)

(73) Assignee: Steinbach & Vollmann GmbH (DE)

( * ) Notice: Subject to any disclaimer, the term of this patent is extended or adjusted under 35 U.S.C. 154(b) by 553 days.

(21) Appl. No.: 12/443,658

(22) PCT Filed: Oct. 5, 2007

(86) PCT No.: PCT/EP2007/008651

§ 371 (c)(1),
(2), (4) Date: Mar. 30, 2009

(87) PCT Pub. No.: WO2008/040553

PCT Pub. Date: Apr. 10, 2008

(65) Prior Publication Data

US 2009/0320376 A1 Dec. 31, 2009

(30) Foreign Application Priority Data

Oct. 7, 2006 (DE) ..... 10 2006 047 562

(51) Int. Cl.
*E05C 3/06* (2006.01)
*E05F 11/00* (2006.01)

(52) U.S. Cl. ..... 292/200; 292/1; 292/DIG. 46; 49/276

(58) Field of Classification Search ..... 49/276, 49/277, 278; 292/1, 15, 23, 73, 75, 77, 79, 292/194, 195, 200, 202, 239, DIG. 46
See application file for complete search history.

(56) References Cited

U.S. PATENT DOCUMENTS 386,343 A * 7/1888 Perkins ..... 49/276
399,423 A * 3/1889 Maltbic ..... 292/241
418,462 A * 12/1889 Heiney ..... 292/66
1,081,294 A * 12/1913 Darrow ..... 49/278
1,232,302 A * 7/1917 Harris et al. ..... 292/108
(Continued)

FOREIGN PATENT DOCUMENTS

DE 203 05 108 U1 7/2003
(Continued)

OTHER PUBLICATIONS

Official Translation of DE 20305108 U1.*
(Continued)

*Primary Examiner* — Carlos Lugo
*Assistant Examiner* — Alyson M Merlino
(74) *Attorney, Agent, or Firm* — Harness, Dickey & Pierce, P.L.C.

(57) ABSTRACT

The present invention relates to an opening means (1) for a closing unit (14), having a bearing (2) which can be fastened on a closing unit (14), and having two pivotable lever arm parts (3, 4), of which one circle sector-like pivoting plane is perpendicular, and a further pivoting plane is essentially parallel to the plane of the closing unit (14), wherein one lever arm part is a force arm (4) and one lever arm part is a load arm (3), characterized in that when the force arm (4) is pivoted in its circle sector-like plane which is perpendicular to the plane of the closing unit (14), the load arm (3) is simultaneously pivoted via a coupling, in the opposite direction to the force arm (4), in its circle sector-like plane perpendicular to the plane of the closing unit (14).

40 Claims, 7 Drawing Sheets

U.S. PATENT DOCUMENTS

| | | | | | |
|---|---|---|---|---|---|
| 1,256,934 | A | * | 2/1918 | Schutz | 292/221 |
| 1,566,689 | A | * | 12/1925 | O'Connor | 292/113 |
| 1,571,899 | A | * | 2/1926 | Haseltine | 49/277 |
| 1,573,063 | A | * | 2/1926 | Haseltine | 292/210 |
| 1,649,626 | A | * | 11/1927 | Thalheimer | 49/277 |
| 1,654,180 | A | * | 12/1927 | Madland et al. | 49/278 |
| 1,672,507 | A | * | 6/1928 | Treptow | 49/278 |
| 2,002,304 | A | * | 5/1935 | Wasberg | 49/276 |
| 2,295,827 | A | * | 9/1942 | Breen et al. | 49/276 |
| 2,381,966 | A | * | 8/1945 | Bishop et al. | 49/214 |
| 2,405,887 | A | * | 8/1946 | Hoffman | 49/278 |
| 2,481,590 | A | * | 9/1949 | Haseltine | 49/219 |
| 2,511,425 | A | * | 6/1950 | Beauchamp | 292/218 |
| 5,469,661 | A | * | 11/1995 | Finkelstein et al. | 49/276 |
| 5,882,053 | A | * | 3/1999 | Bekins et al. | 292/336.3 |

FOREIGN PATENT DOCUMENTS

| | | | |
|---|---|---|---|
| FR | 2 237 488 | A | 2/1975 |

OTHER PUBLICATIONS

Translation of International Preliminary Report on Patentability for PCT/EP2007/008651 (Oct. 5, 2007).

* cited by examiner

OPENING MEANS FOR A CLOSING UNIT

CROSS-REFERENCE TO RELATED APPLICATIONS

This application is a U.S. National Stage Application of International application No. PCT/EP2007/008651, filed Oct. 5, 2007. This application claims the benefit of German Application No. 10 2006 047 562.3 filed Oct. 7, 2006. The disclosures of the above applications are incorporated herein by reference.

The present invention relates to an opening means for a closing unit, having a bearing which can be fastened on a closing unit, and having two pivotable lever arm parts, of which one circle sector-like pivoting plane is perpendicular and a further pivoting plane is essentially parallel to the plane of the closing unit, wherein one lever arm part is a force arm and one lever arm part is a load arm.

Opening means for closing units are known, and the term "closing unit" is understood to mean the most different units for closing an opening such as for example doors, in particular sliding doors, partitions or the like.

Opening means for sliding doors are known which are also called push-off mechanisms that consist of a bearing that can be fixed to a sliding door and a lever arm. On pivoting the push-off mechanism the same can push off on an abutment arranged on the sliding-door frame or on the sliding-door frame itself and thus serves for easy opening of the sliding door. But as mentioned above, instead of a sliding door also a partition or the like can be equipped with a push-off mechanism.

The present invention is based on the object of providing an opening means which is improved compared to conventional opening means.

According to the invention this object is achieved in that when the force arm is pivoted in its circle sector-like plane which is perpendicular to the plane of the closing unit, the load arm is simultaneously pivoted via a coupling, in the opposite direction to the force arm, in its circle sector-like plane which is perpendicular to the plane of the closing unit.

According to the invention the bearing includes an opening means arranged on one side of the closing unit and composed of a bearing fixed to the closing unit and two lever arm parts supported for pivoting on the bearing. Thus the lever arm parts can be pivoted through the bearing both in a plane substantially parallel to the plane of the closing unit and in a circle sector-like planes, these planes being perpendicular to the plane of the closing unit. The advantage of this latter-mentioned pivotability is that during pivoting of the lever arm parts to push-off the load arm on a frame of a closing unit, a seal provided on the closing unit will remain undamaged, since the load arm can be pivoted away from the plane of the closing unit thus passing the seal without contact. The pivoting of the force arm allows the force arm to be securely grabbed, even with gloves. The complete opening of the closing unit is guaranteed by the automatic return of the lever arm parts to the initial position. Thus they fit through the gap between closing unit and frame, which is required for the seal.

An advantageous embodiment of the invention provides that the bearing includes a bearing ring that is fixed to the closing unit. This can be done by screwing, riveting, welding or the like. For screwing or welding, the bearing ring can have at least one bore serving to receive a screw or rivet.

A further advantageous embodiment of the invention provides that the bearing includes a bearing block rotatably connected to the bearing ring and supported for pivoting on the two lever arm parts.

According to a further advantageous embodiment the bearing includes a resilient element arranged on the bearing block and having the function described in the following. The element can be a pressure spring or an element made from an elastic material.

According to a further advantageous embodiment of the invention the bearing includes a fixing element connecting the bearing block to the bearing ring. This fixing element can be a nut, a clamping ring or a pin, and shimming of these means can be provided for example to prevent the nut from loosening.

A further advantageous embodiment of the invention provides that the bearing includes at least one element limiting the pivotability of the opening means. This element can be in the form of a protrusion, a ball or also a resiliently supported element or an element that is somehow elastic.

A further advantageous embodiment of the invention provides that the bearing includes a seal protecting the bearing from the penetration of water or humidity and from other environmental influences and thus guaranteeing a long service life of the opening means.

According to a further advantageous embodiment of the invention the bearing ring includes a recess in which a part of the bearing block can be inserted to which the fixing element can then be attached for connecting the bearing block to the bearing ring. Depending on the design of the invention, the recess can be provided centrally or also eccentrically on the bearing ring.

A further advantageous embodiment of the invention provides that the bearing ring includes at least one seat intended to receive an element limiting the pivotability of the opening means. The seat can be in the form of a round or somehow square recess and is situated preferably eccentrically on the bearing ring.

A further advantageous embodiment of the invention provides that the bearing block includes a pin. This pin is preferably centrally attached to the bearing block, but can also be arranged eccentrically. The pin is inserted in the recess of the bearing ring and for this purpose has approximately the same diameter as the recess. But the diameter of the recess of the pin can also be smaller than the diameter of the recess of the bearing ring, so that a guide sleeve can be interposed between the pin and the recess.

According to a further advantageous embodiment of the invention the bearing block includes a seat serving to receive an element limiting the pivotability of the opening means. The seat can be in the form of a round or somehow square bore and is preferably eccentrically arranged on the bearing block.

According to a further advantageous embodiment of the invention the bearing block includes a second seat serving to receive the resilient element. The seat is formed as a bore in the pin of the bearing block and is preferably arranged centrally in the pin, but can also be arranged eccentrically on the pin.

A further advantageous embodiment of the invention provides that the bearing block includes at least one guide serving to guide an element limiting the pivotability of the opening means, which exists essentially parallel to the plane of the closing unit. Preferably two circular arc-shaped guides are provided on the bearing block, which allow the limitation of the pivotability of the opening means in two directions. These guides can be further provided in the form of round or somehow square cavities in the bearing block.

According to a further advantageous embodiment of the invention the bearing block includes at least one and preferably two shoes to which the lever arm parts can be fixed and which simultaneously guide the lever arm parts laterally, so that the forces occurring during the push-off movement of the opening means can be well compensated, thus considerably increasing the service life of the opening means.

A further advantageous embodiment of the invention provides that the bearing block includes at least one and preferably more bolts that can be fixed in bores in the shoes of the bearing block and about which the lever arm parts can be pivoted. The bolts can be provided with a thread allowing the bolts to be connected by screws to the shoes, through internal threads that are possibly provided in the bores of the shoes. The bolts can have a varying length and can also be locked to the bearing block by means of a pin or a clamping ring.

According to a further preferred embodiment of the invention the load arm includes a roller that is located on the end of the load arm directed away from the bearing block. During the push-off movement the roller is applied against the frame of the closing unit, whereupon the closing unit opens as the pivoting movement of the opening means is continued, and the roller can move along the frame. This guarantees easy operation of the opening means and prevents damage to the frame. The roller can have different diameters and can be made from different materials such as metal or a ceramic material, but preferably a plastic material.

An advantageous embodiment of the invention provides that the load arm is supported for pivoting on the bearing block. To this end the load arm is provided on its end facing towards the bearing block with a bore. The bolt about which the load arm can be pivoted is passed through this bore. Thus the load arm can be pivoted in a circle sector-like plane which is perpendicular to the plane of the closing unit.

According to a further advantageous embodiment of the invention the load arm includes a coupling element on its end than can be fixed to the bearing block. This coupling element is preferably formed in the axial direction of the load arm and has an oblate cross section compared to the cross section of the load arm.

A preferred embodiment of the invention provides that the coupling element is constructed in the form of an appendix which is either integral with the rest of the load arm or is constructed as a separate element, so that it can be exchanged after it is worn. The integral construction has the advantage that lesser components are required thus making the production and mounting of the opening means easier. The appendix can have different forms, for example a round or somehow square cross section. Also the length of the appendix can vary as required.

A further advantageous embodiment of the invention provides that the force arm includes a handle. This can be constructed integrally with the force arm or as a separate element. The separate element can be glued, screwed or otherwise connected to the force arm, and its construction can vary. Furthermore the handle can have a round or somehow square cross section and can be so constructed that a convenient non-skid form profile is given. The handle can further consist of various materials such as metal, plastic or ceramic or it can consist of interconnected combinations of individual components consisting of these materials.

According to a further advantageous embodiment of the invention the force arm is fixed for pivoting on the bearing block. To this end the force arm has a bore on its end that can be fixed to the bearing block, and a bolt about which the force arm can pivot is passed through this bore. Thus the force arm is pivotable in a circle sector-like plane that is perpendicular to the plane of the closing unit.

A further advantageous embodiment of the invention provides that the force arm includes a coupling element on its end that can be fixed to the bearing block. This is preferably formed in the axial direction of the force arm and has cross sectional surface which is different from that of the remaining force arm. This coupling element couples to the coupling element of the load arm, whereby when the force arm is pivoted in the circle sector-like plane, the load arm is also pivoted in a circle sector-like plane, wherein both circle sector-like planes are perpendicular to the plane of the closing unit. Furthermore the coupling element can be constructed integrally with the remaining force arm or as a separate element, the latter offering the option of replacement after wear. The integral construction of force arm and coupling element has the advantage of an easier production and mounting of the opening means.

According to a further advantageous embodiment of the invention the coupling element is constructed as an appendix that can have a round or somehow square cross sectional surface and a length that varies depending on the respective requirements.

A further advantageous embodiment of the invention provides that the appendix of the force arm is constructed complementary to the appendix of the load arm which guarantees good and secure coupling of the two lever arm parts.

According to a further advantageous development of the invention the force arm includes a second appendix on its end that can be fixed to the bearing block. This second appendix is preferably formed in the radial direction of the force arm and serves to permit pivoting of the lever arm parts in the direction of the plane of the closing unit only after the opening means has returned to its preferably essentially vertical rest position. This additionally guarantees that the seal provided on the closing unit remains undamaged. The appendix can be constructed integrally with the force arm or as a separate element. The integral construction has the advantage of easier production and mounting of the opening means, whereas the construction as a separate element offers the option of replacement after wear. The appendix can have a round or somehow square cross sectional shape and its length can vary depending on the respective requirements. Being a separate element, the appendix can also be made from different materials.

According to a further advantageous embodiment of the invention the seal of the bearing includes a plastic element that guarantees good sealing of the bearing against environmental influences thus extending the functional life of the bearing. Preferably the plastic element is in the form of a plastic washer that can have different dimensions.

A further advantageous embodiment of the invention provides that the seal includes an O-ring which also protects the bearing against environmental influences thus extending the service life of the bearing and hence the opening means.

According to a further advantageous embodiment of the invention the opening means can be used without retrofitting and irrespectively of the opening direction of the closing unit. Thus a high degree of standardization is achieved which improves the possible application of the opening means.

The invention will be now be described in more detail with reference to the attached drawing figures showing embodiments of the invention. In the drawings it is shown by FIG. 1 an opening means in the rest position;

FIG. 2 an opening means in the pivoted position;

FIG. 3 an opening means mounted to a closing unit, in the rest position;

FIG. 4 an opening means mounted to a closing unit, in the pivoted position;

FIG. 5 a bearing ring in a front view;

FIG. 6 a bearing ring in a rear view;

FIG. 7 a cross sectional view of an opening means in the rest position and

FIG. 8 a front view of an opening means in the rest position.

FIG. 1 is a perspective view of an opening means (1) in the rest position. The bearing (2), the load arm (3) and the force arm (4) can be seen. The bearing (2) includes a bearing ring (5) which is provided with bores (6) for fixing to a closing unit (14). The bearing block (7) has two shoes (8) which are each provided with two bores (9) for receiving the bolts (10). A roller (11) is provided on the load arm (3) and is fixed to the load arm by a bolt (12) and supported for rotation about the latter. The force arm (14) includes a handle (13) which in this embodiment has a larger diameter than the force arm (4). The bearing block (7) is rotatably connected to the bearing ring (5). Furthermore the two lever arm parts (3, 4) are pivotably connected to the bearing block (7) by means of the bolts (10). Between the shoes (8) of the bearing block (7) the two lever arm parts (3, 4) are coupled to each other.

Figure 1:
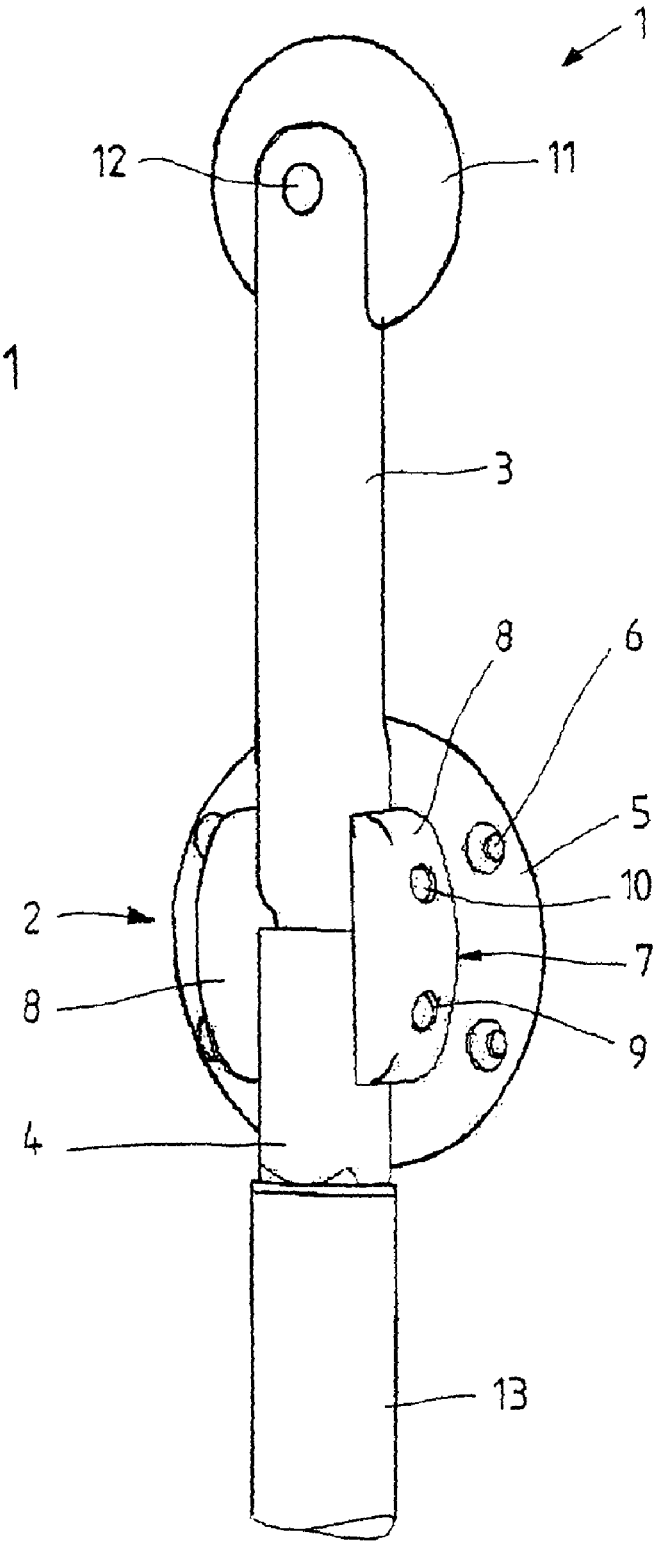
Figure 2:
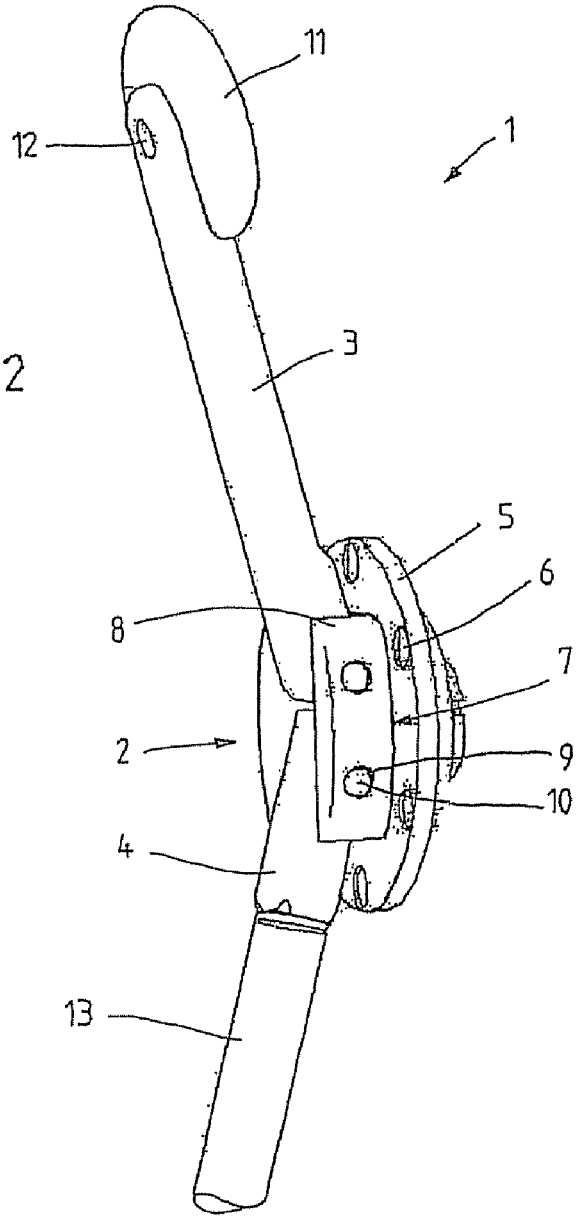
FIG. 2 is a perspective view of the opening means (1) in the pivoted position. Since the force arm (4) has been pivoted in its circle sector-like plane, also the force arm (3) has been pivoted in its circle sector-like plane, via the coupling of the two lever arm parts (3, 4).
Figure 3:
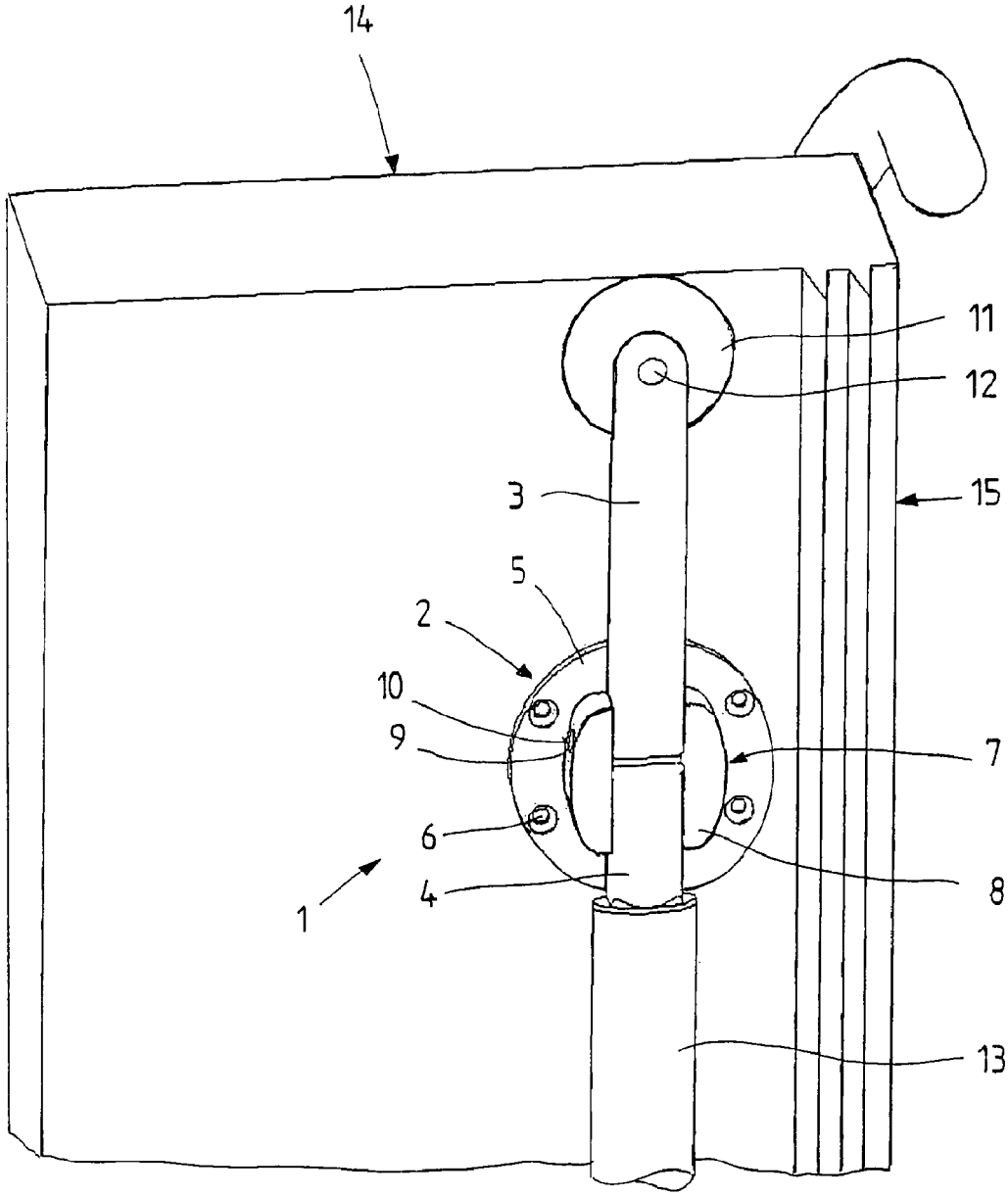
FIG. 3 shows an opening means (1) mounted to a closing unit (14) in the rest position. Laterally on the closing unit (14) a seal (15) is provided to the seal the closable space against environmental influences.
Figure 4:
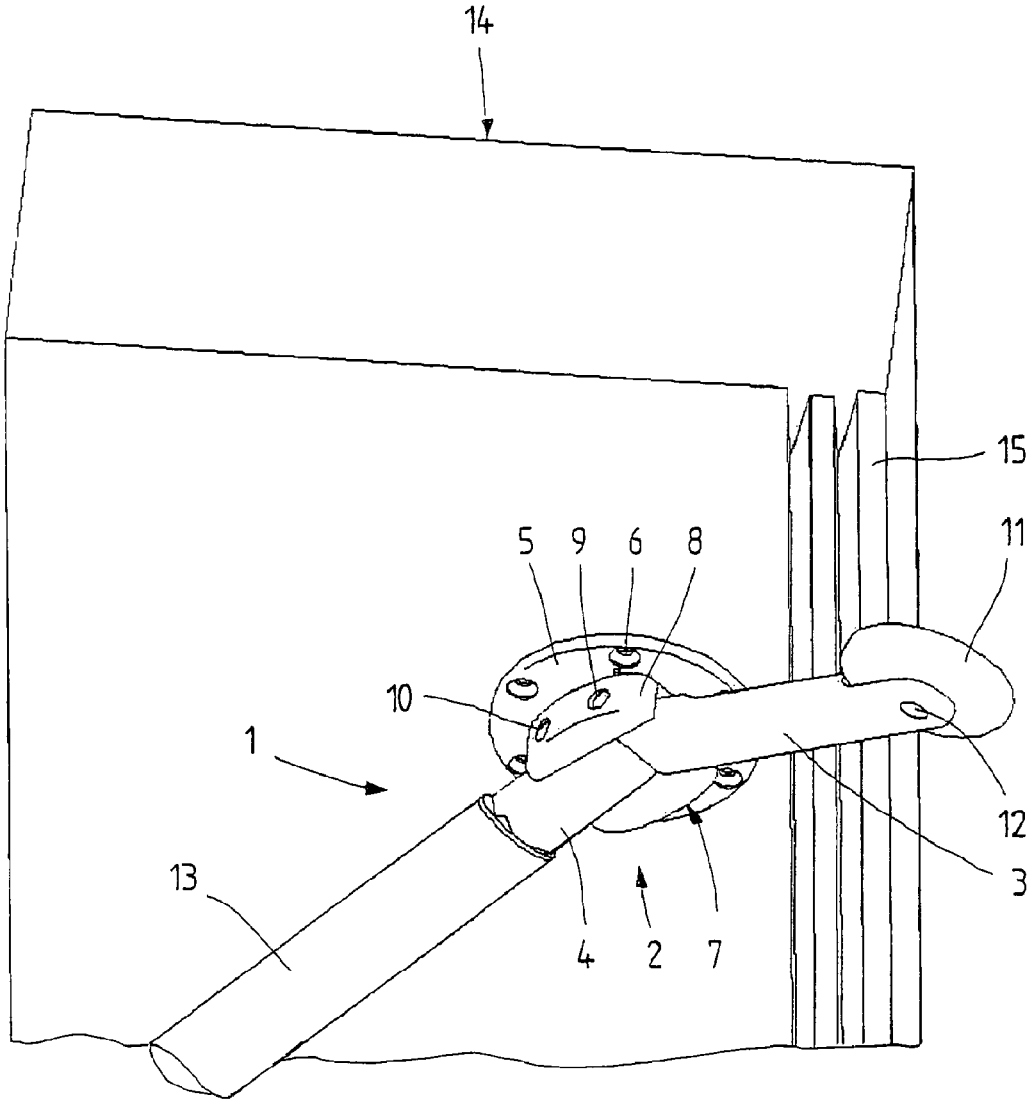

FIG. 4 shows an opening means (1) mounted to a closing unit (14) in the pivoted position. It can be seen that in this position the load arm (3) pivots past the seal (15) without contact. Thus the seal is not damaged and a push-off movement on a frame (not illustrated) of the closing unit (14) can take place via the roller (11) of the load arm (3), said roller (11) rolling along the frame during pivoting.

Figure 5:
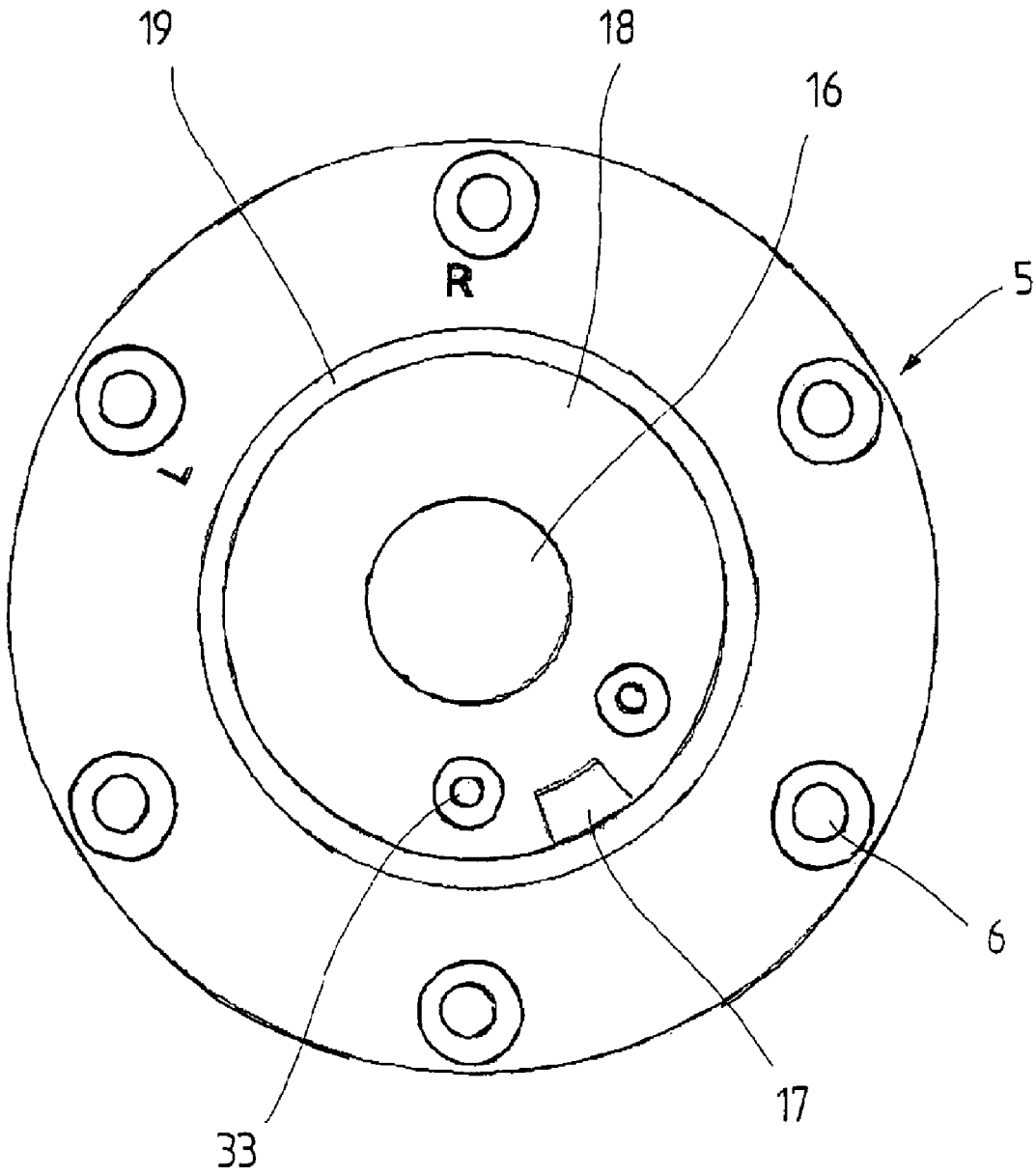

FIG. 5 shows a bearing ring (5) of the bearing (2) in a front view. The bearing ring (5) has in the center thereof a recess (16) and an element (17) limiting the pivotability of the lever arm parts (3, 4) essentially parallel to the plane of the closing unit (14), and in this embodiment the element is constructed as a square protrusion. The recess (16) is arranged in a circular central cavity (18) and serves to receive a pin (20) provided on the bearing block. The bearing ring (5) further has a continuous groove (19) around the rim of the cavity (18), and in this groove an O-ring (27) can be placed to protect the bearing (2) against environmental influences. The protrusion (17) is guided in the guide (22) of the bearing block (7), so that a pivoting movement of the lever arm parts (3, 4) and thus of the bearing block (7) is limited by the length of the guide (22). The two seats (33) of the bearing ring (5) serve to receive a second element (26) limiting the pivotability of the lever arm parts in their circle sector-like planes. FIG. 5 also shows that the opening means (1) can be used regardless of the opening direction of the closing unit (14), which is due to the fact that the bearing ring (5) can be fixed on one side in the upper position on the closing unit (14) by the bore identified by the letter R, as illustrated in FIG. 5, which applies if the opening direction of the closing unit (14) is to the right side. On the other side the bearing ring (5) can be fixed to the closing unit (14) by means of a bore located in an upper position identified by the letter L, which applies if the opening direction of the closing unit (14) is to the left side. To provide for an even greater flexibility of use, two seats instead of one seat (33) are provided on the bearing ring (5), as shown in this embodiment.

Figure 6:
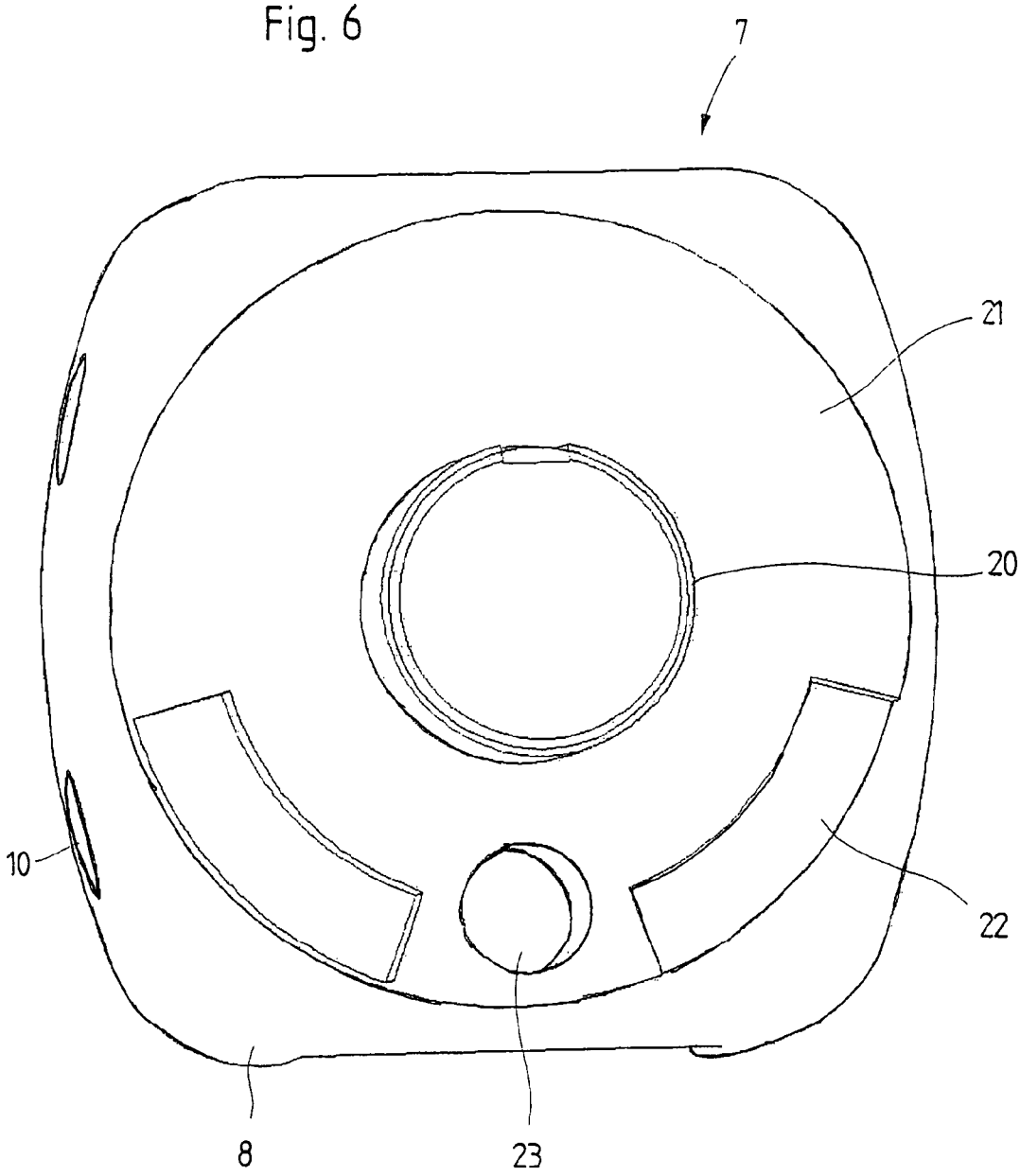

FIG. 6 is a rear perspective view of a bearing block (7) having the pin (20) which is inserted in the recess (16) of the bearing ring (2). The bearing block (7) further includes a cavity (21) having two guides (22) constructed thereon in the form of circular arc-shaped depressions. The same serve to guide the element (17) limiting the pivotability of the bearing (2), and to allow the opening means (1) to be used in closing units (14) with left and right opening directions, two guides (22) are provided. Also the cavity (21) of the bearing block (7) includes a seat (23) having seated therein the element (26) limiting the pivotability of the lever arm parts (3, 4) and thus of the bearing block (7), which pivotability is given essentially parallel to the plane of the closing unit (14). Furthermore the shoes (8) of the bearing block (7) can be seen, to which the bolts (10) are fixed which are passed through the bores (9) of the shoes (8).

Figure 7:
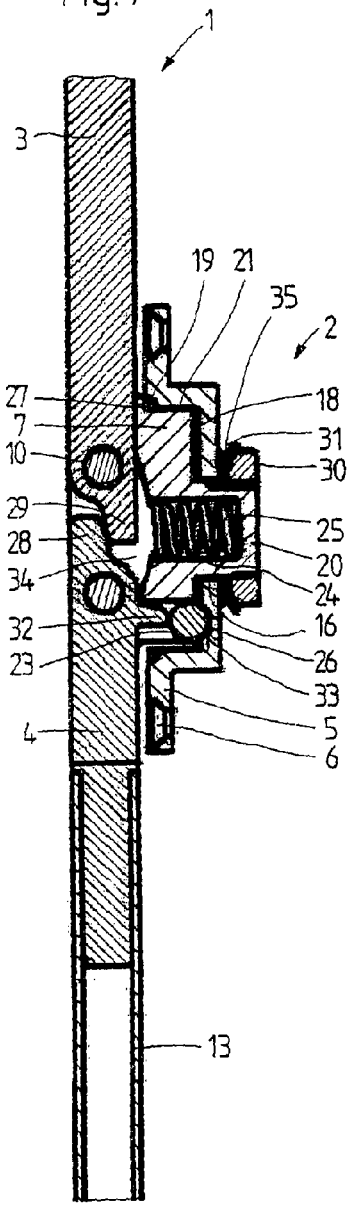

FIG. 7 shows a longitudinal section through the opening means (1). The supporting of the lever arm parts (3, 4) on the bolts (10) can be seen, and for their coupling the lever arm parts (3, 4) include the mutually complementary appendices (28, 29) in the axial direction respectively. When the force arm (4) is pivoted, its appendix (28) will press against the appendix (29) of the load arm (3), whereby the load arm is also pivoted to prevent the seal (15) on the closing unit (14) from being damaged during the pivoting movement of the lever arm parts (3, 4) essentially parallel to the plane of the closing unit (14). Furthermore the fixing element (30) can be seen which in this embodiment is constructed as a nut (30) that is provided with a lock washer (31) and that is screwed to the pin (20) after inserting the pin (20) of the bearing block (7) in the central recess (16) of the bearing ring (5). Thus the bearing block (7) and the bearing ring (5) are connected to each other for rotation relative to each other. The pin (20) of the bearing block (7) also has a second seat (24) serving to receive the resilient element (25) which in this embodiment is constructed as a pressure spring (25). During the pivoting movement of the lever arm parts (3, 4) in their circle sector-like planes this pressure spring presses against the appendix (29) of the load arm (3) to facilitate a pivoting movement of the lever arm parts (3, 4) to their rest position. This however is possible only if the lever arm parts (3, 4) are in an essentially vertical position, since the element (26) which limits the pivotability of the opening means (1) and which in this embodiment is constructed as a ball (26) and is arranged in the seat (23) of the bearing block (7) will then be situated in the seat (33) and thus not push against the appendix (32) formed in the radial direction on the force arm (4). Furthermore the O-ring (27) can be seen in FIG. 7, which is arranged in the continuous groove (19) around the cavity (18) of the bearing ring (5) for sealing the bearing (2). In the embodiment of the invention illustrated in FIG. 7 the handle (13) of the force arm (4) is constructed as a tubular element having the same radius as the force arm (4) and being attached to the force arm. The bearing block (7) additionally includes a funnel-shaped cavity (34) between the rim and the seat (24) into which the appendices (28, 29) of the lever arm parts (3, 4) can pivot to provide for the circle sector-like pivotability of the lever arm parts (3, 4) and to limit the excursion of the lever arm parts (3, 4). Furthermore the plastic element (35) can be seen in FIG. 7, which is arranged between the bearing ring (5) and the locking washer (31) for sealing.

Figure 8:
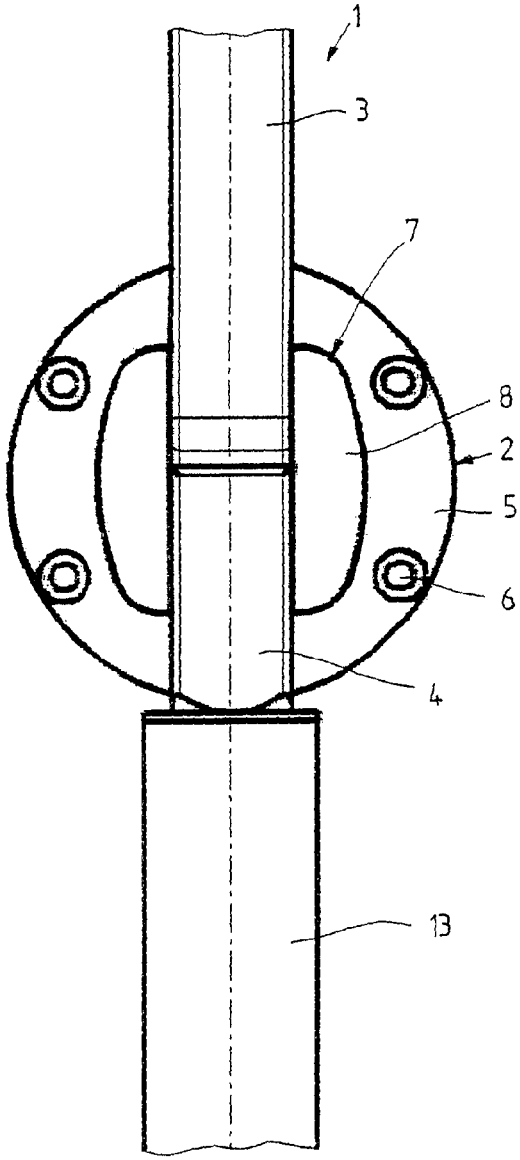

FIG. 8 shows in a front view the opening means (1) in an alternative embodiment in which the handle (13) has a larger diameter than the force arm (4), for improving manageability.

The described embodiments merely serve to more clearly explain the invention and are not in any way limiting to the invention.

The invention claimed is:

1. An opening means for a closing unit adapted to close an opening, the opening means operable to act upon an abutment or a frame of the opening to open the opening by moving the closing unit, the opening means comprising:

a bearing configured to be fastened on the closing unit;

a lever arm assembly including a force arm and a load arm each pivotally mounted to the bearing and pivotable in a first plane parallel to a plane of the closing unit and a second plane perpendicular to the plane of the closing unit; and a coupling including a first coupling element and a second coupling element, the coupling couples the force arm and the load arm such that pivoting of the force arm in the second plane pivots the load arm in the second plane.

2. The opening means according to claim 1, wherein the bearing includes a bearing ring.

3. The opening means according to claim 1, wherein the bearing includes a bearing block.

4. The opening means according to claim 1, wherein the bearing includes a resilient element.

5. The opening means according to claim 1, wherein the bearing includes a fixing element.

6. The opening means according to claim 1, wherein the bearing includes at least one element limiting pivotability of the first coupling element and the second coupling element.

7. The opening means according to claim 1, wherein the bearing includes a seal.

8. The opening means according to claim 2, wherein the bearing ring includes a recess.

9. The opening means according to claim 2 or 8, wherein the bearing ring includes at least one seat.

10. The opening means according to claim 3, wherein the bearing block includes a pin.

11. The opening means according to claim 3 or 10, wherein the bearing block includes a first seat.

12. The opening means according to claim 11, wherein the bearing block includes a second seat.

13. The opening means according to claim 3 or 10, wherein the bearing block includes at least one guide.

14. The opening means according to claim 3 or 10, wherein the bearing block includes at least one shoe.

15. The opening means according to claim 3 or 10, wherein the bearing block includes at least one bolt.

16. The opening means according to claim 1, wherein the load arm includes a roller.

17. The opening means according to claim 1 or 16, wherein the load arm is pivotally mounted on the bearing.

18. The opening means according to claim 1 or 16, wherein the load arm includes the first coupling element at its end that is fastened to the bearing; and wherein pivoting the force arm in the second plane pivots both the force arm and the load arm in the second plane in the opposite direction, the force arm includes the second coupling element.

19. The opening means according to claim 18, wherein the first coupling element is in the form of an appendix.

20. The opening means according to claim 1, wherein the force arm includes a handle.

21. The opening means according to claim 3, wherein the force arm is pivotally fixed on the bearing block.

22. The opening means according to claim 3, wherein the force arm includes the second coupling element at its end that is fastened to the bearing block.

23. The opening means according to claim 22, wherein the second coupling element is in the form of a first appendix.

24. The opening means according to claim 1, wherein the first coupling element and the second coupling element are formed complementary to each other.

25. The opening means according to claim 23, wherein the force arm includes a second appendix at its end that is fixed to the bearing block.

26. The opening means according to claim 7, wherein the seal comprises a plastic element.

27. The opening means according to claim 7 or 26, wherein the seal comprises an O-ring.

28. The opening means according to claim 1, wherein the opening means is configured for use independent from an opening direction of the closing unit to avoid retrofitting of the opening means in dependence on the opening direction of the closing unit.

29. The opening means according to claim 11, wherein the bearing block includes at least one guide.

30. The opening means according to claim 12, wherein the bearing block includes at least one guide.

31. The opening means according to claim 11, wherein the bearing block includes at least one shoe.

32. The opening means according to claim 12, wherein the bearing block includes at least one shoe.

33. The opening means according to claim 13, wherein the bearing block includes at least one shoe.

34. The opening means according to claim 11, wherein the bearing block includes at least one bolt.

35. The opening means according to claim 12, wherein the bearing block includes at least one bolt.

36. The opening means according to claim 13, wherein the bearing block includes at least one bolt.

37. The opening means according to claim 14, wherein the bearing block includes at least one bolt.

38. The opening means according to claim 17, wherein the load arm includes the coupling element at its end that is fastened to the bearing block.

39. The opening means according to claim 21, wherein the force arm includes the second coupling element at its end that is fastened to the bearing block.

40. The opening means according to claim 21, wherein the second coupling element includes a second appendix at its end that is fixed to the bearing block.

* * * * *